US007798335B2

(12) United States Patent
McKinney, Jr. et al.

(10) Patent No.: US 7,798,335 B2
(45) Date of Patent: Sep. 21, 2010

(54) CLOTHING ACCESSORY ORGANIZER

(75) Inventors: Edward C. McKinney, Jr., Novato, CA (US); Tristan M. Christianson, San Francisco, CA (US)

(73) Assignee: Sharper Image Acquisition LLC, New York, NY (US)

( * ) Notice: Subject to any disclaimer, the term of this patent is extended or adjusted under 35 U.S.C. 154(b) by 43 days.

(21) Appl. No.: 11/282,561

(22) Filed: Nov. 18, 2005

(65) Prior Publication Data

US 2007/0012633 A1 Jan. 18, 2007

Related U.S. Application Data

(60) Provisional application No. 60/629,870, filed on Nov. 19, 2004.

(51) Int. Cl.
*F21V 33/00* (2006.01)

(52) U.S. Cl. ..... 211/1.56; 211/1.51; 211/1.52; 211/1.53; 211/1.55; 211/85.3; 362/154; 362/190; 362/194

(58) Field of Classification Search ..... 211/1.52, 211/1.3, 1.56, 1.51, 122, 40, 1.55, 85.3, 1.53, 211/1.54; 362/234, 367, 154, 183, 190, 194–196
See application file for complete search history.

(56) References Cited

U.S. PATENT DOCUMENTS 2,275,749 A * 3/1942 Fisher ..... 211/120
3,335,872 A * 8/1967 Dodich ..... 211/85.3
D288,035 S * 2/1987 Hollinger et al. ..... D6/324
4,742,924 A * 5/1988 Tarlow et al. ..... 211/60.1
4,771,895 A * 9/1988 Steiner ..... 211/1.3
D298,591 S * 11/1988 Arner et al. ..... D6/315
5,560,076 A * 10/1996 Leung ..... 15/339
5,645,173 A * 7/1997 Taylor et al. ..... 211/1.56
5,645,340 A * 7/1997 Colton ..... 362/489
D383,315 S * 9/1997 Woodring ..... D6/315
5,836,675 A * 11/1998 Woodring ..... 362/234
D406,258 S * 3/1999 Segers ..... D13/103
6,464,088 B1 * 10/2002 Caplan et al. ..... 211/40
6,871,749 B2 * 3/2005 Bostick et al. ..... 211/94.01
6,905,035 B2 * 6/2005 McKinney, Jr. ..... 211/85.3
7,384,170 B2 * 6/2008 Skegin ..... 362/240
2003/0226814 A1 * 12/2003 Taylor et al. ..... 211/40

* cited by examiner

*Primary Examiner*—Katherine W Mitchell
*Assistant Examiner*—Colleen M Quinn
(74) *Attorney, Agent, or Firm*—Arent Fox LLP

(57) ABSTRACT

An apparatus for organizing articles of clothing is disclosed, including a housing having first and second drums rotatably mounted thereto. A drive system is used for rotating a belt around the first and second drums. The belt includes a plurality of hooks for hanging articles thereon. In one embodiment, the apparatus mounts on a closet rod and further includes a posterior end with an adjustable telescoping sleeve to stabilize the mounted apparatus against a wall. The apparatus can include a removable battery pack mounted to the underside of the apparatus. The removable battery pack can have a light bulb mounted on it to illuminate the selection of articles on the hooks. In another embodiment, the apparatus includes a rod-mounting apparatus that has a length that prevents or minimizes entanglement of articles hanging on the apparatus with other articles hanging near the apparatus.

25 Claims, 15 Drawing Sheets

CLOTHING ACCESSORY ORGANIZER

PRIORITY CLAIM

This application is a non-provisional of and claims priority to and the benefit of U.S. Patent Application Ser. No. 60/629,870, filed Nov. 19, 2004, the entire contents and disclosures of which are incorporated herein.

BACKGROUND

The storage of clothing accessories, such as neckties, scarves, belts, and other similar articles, is difficult because such accessories are typically flexible and have narrow widths and long lengths. Various static devices, such as conventional clothing hangers, hooks, rods, and the like, have been used to store clothing accessories. These static devices position the accessories very close together, often overlapping, such that an individual accessory cannot be located and retrieved without disturbing, or even removing, other accessories.

Various dynamic devices, such as those disclosed in U.S. Pat. Nos. 2,275,749 to Fisher, U.S. Pat. No. 4,742,924 to Tarlow et al., Des. 229,909 to Goldfeder, and Des. 298,591 to Arner et al., have also been used to store clothing accessories. However, these dynamic devices suffer from a number of disadvantages, a few of which are inadequate control for easy location and retrieval of accessories, inadequate lighting, difficult installation, inefficient use of space, and interference with other articles stored in proximity to the articles on the dynamic devices.

Thus, there is a need for an apparatus for storing clothing and accessories which overcomes the disadvantages of the above mentioned static and dynamic devices.

SUMMARY

The present invention provides an apparatus for storing clothing accessories which overcomes disadvantages of static and dynamic devices. The apparatus includes a housing that has a mounting unit and a motor. The motor powers a conveyer such as a belt which moves a plurality of hooks. The device can be powered by a battery pack that is releasably attached to the housing.

Additional features and advantages are described herein, and will be apparent from, the following Detailed Description and the figures.

DETAILED DESCRIPTION

Figure 1A:
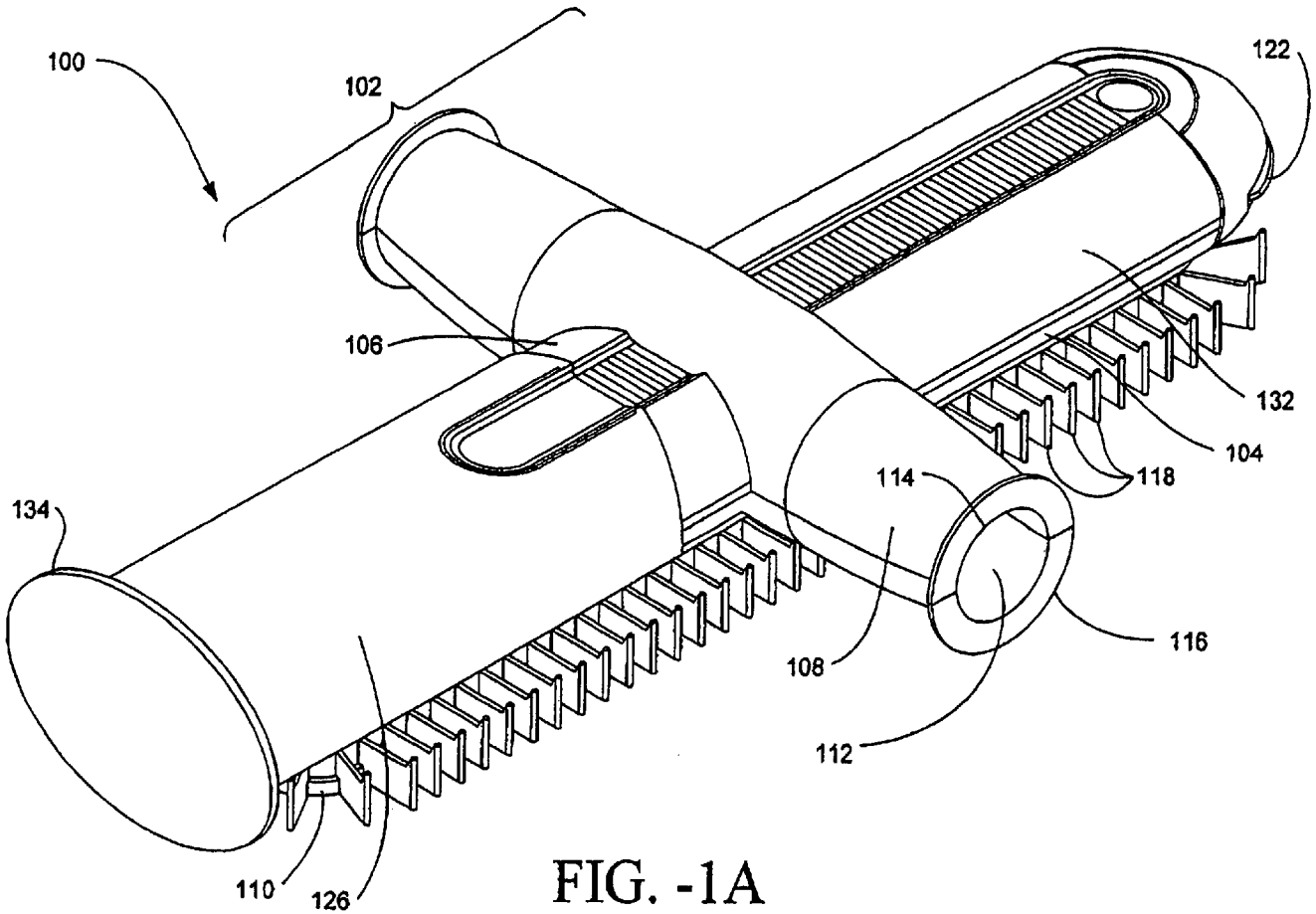
FIG. 1A is a perspective view of the apparatus in accordance with the present invention.

Embodiments of the present invention provide an apparatus for organizing articles of clothing. The apparatus includes a housing having first and second drums rotatably mounted thereto. A belt is engaged around the first and second drums. The belt has a plurality of first holders or hook members for hanging articles thereon. A drive system is used for rotating at least one of the first and second drums to cause rotation of the belt. An automatic control system activates the drive system for a period of time. The motor can be powered by a battery pack, which is removable without dismounting the apparatus. The mounting portion of the apparatus is sufficiently long so that articles hanging near the apparatus do not interfere with articles hanging from the holders or hooks on the belt of the apparatus.

In another embodiment of the present invention, an apparatus for organizing articles of clothing includes a housing having first and second drums rotatably mounted thereto. A belt is engaged around the first and second drums. The belt has a plurality of first hook members for hanging articles thereon. An electric motor having an output shaft is mounted to the housing. A pulley and gear system is connected between the output shaft of the electric motor and one of the first and second drums for rotating one of the first and second drums to cause rotation of the belt. The apparatus includes a battery pack that is removably connected to the rest of the apparatus. The battery pack contains batteries for powering the electric motor and a light source at a distal end of the battery pack. The light illuminates the selection of hanging articles on the first hook members as the articles are rotated by the belt. The light source can be functionally associated with an automatic lighting system that provides electricity to the light source for a time period in response to the electric switch being switched to an on position. The batteries in the battery pack can be replaced by sliding the battery pack off of a closet-mounted apparatus, and then replacing the battery pack with new batteries back onto the rest of the apparatus while the apparatus is still mounted on the closet rod. Also in this embodiment, an electric switch is mounted to the battery pack and coupled to the electric motor. The electric switch has three positions: (1) a first position for switching the electric motor off; (2) a second position for switching the electric motor on so that its output shaft rotates clockwise; and (3) a third position for switching the electric motor on so that its output shaft rotates counter-clockwise. An automatic control system automatically switches the electric motor off after a delay time period in response to the electric switch being switched to one of the on positions (i.e., one of the second and third positions).

In another embodiment of the present invention, the apparatus has a rod mount for securing the housing to a closet rod. The rod mount has a bottom piece having a bottom cylindrical cavity and a top piece having a top cylindrical cavity. The top piece slides and snaps into the bottom piece. The top or bottom pieces can have an adapter within the top cylindrical cavity or the bottom cylindrical cavity to adapt the rod mount to closet rods of different sizes and/or shapes (i.e., oval in cross-section, rather than round). The adapter can be made of wire or other appropriate material to cause the top and/or bottom cylindrical cavities to conform to the closet rod. The bottom piece of the rod mount includes a bore hole for receiving a bolt which has its longitudinal axis positioned substantially parallel to the first and second axes so that the bolt is capable of penetrating into the cylindrical cavity. The bolt is countersunk into the housing between the first drum, the second drum, and the belt. An electric motor having an output shaft is mounted to the housing. A pulley and gear system is connected between the output shaft of the electric motor and one of the first and second drums for rotating one of the first and second drums to cause rotation of the belt. An electric switch is mounted to the housing and coupled to the electric motor for switching the electric motor on and off.

In another embodiment of the present invention, the rod mount has a length that keeps other hanging articles in the closet away from the hanging articles on the first hook members both during rotation and while the apparatus is not rotating the hanging articles.

In a further embodiment of the present invention, a posterior section of the housing of the apparatus is designed so that it abuts and adheres to a wall of the closet when the apparatus is mounted on a closet rod. The posterior section of the housing thus further stabilizes the apparatus when mounted. The posterior section of the housing of the apparatus is capable of a telescoping function. More specifically, a plate is connected with a hollow tube that fits inside the posterior section of the housing and adjustably can slide in and out of the posterior section. To brace the apparatus when it is mounted, the hollow tube is slid out toward a wall of the closet until the plate abuts the wall. Adhesive on the surface of the plate that abuts the wall is used to hold the plate in place, which adhesion of the abutting surface stabilizes the mounted apparatus.

In another embodiment of the present invention, the clothing accessory organizer, referred to herein as "apparatus" 100, has several components that initially will be discussed in general terms in the context of FIGS. IA, 1B, and 1C, and then in greater detail in the context of the figures that follow. These components are: the housing including an endplate/telescoping unit and rod-mounting unit, the belt and hooks, and the battery pack with light bulb.

Figure 1B:
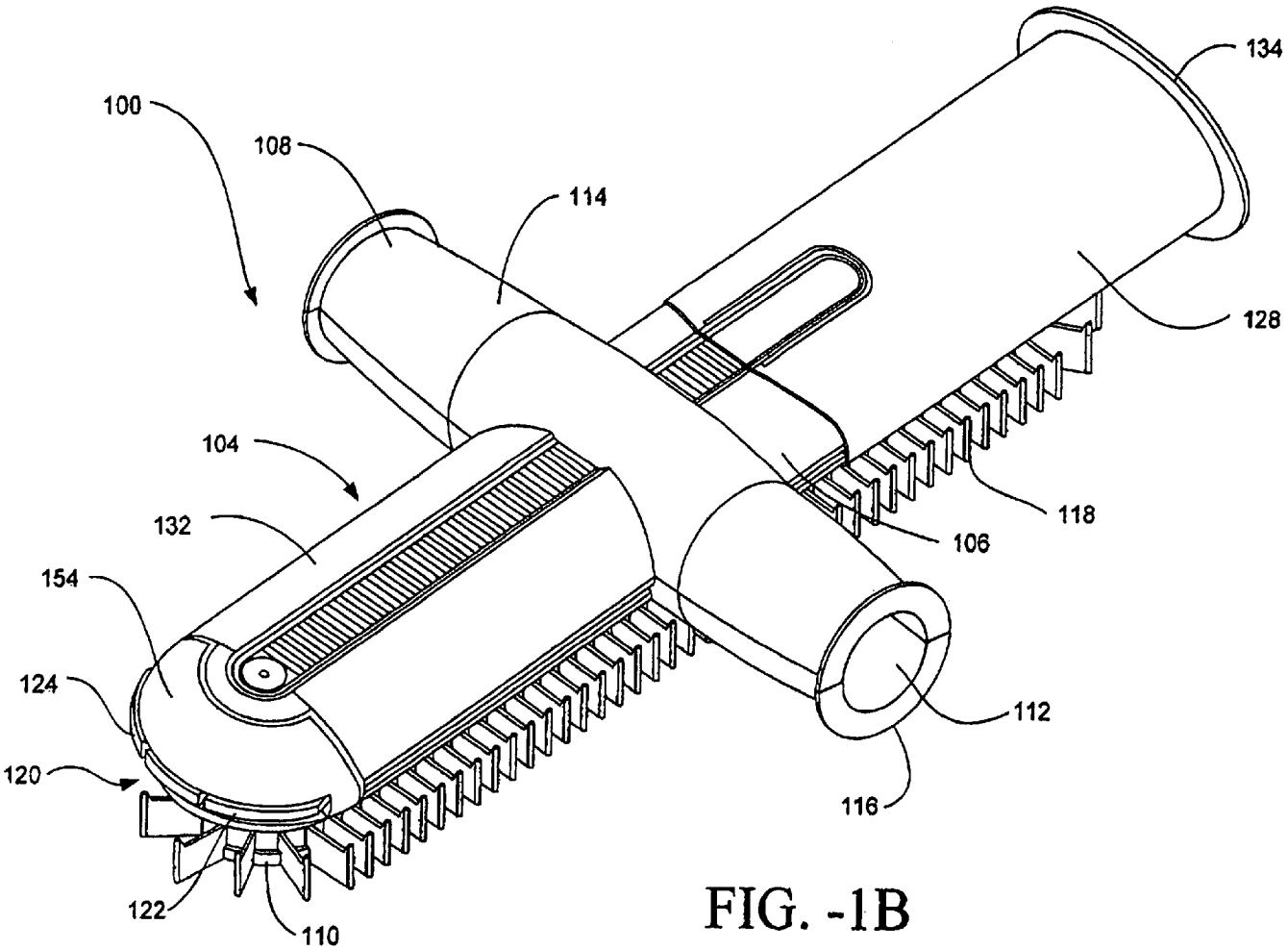
FIG. 1B is a perspective view of the apparatus in accordance with the present invention.
Figure 1C:
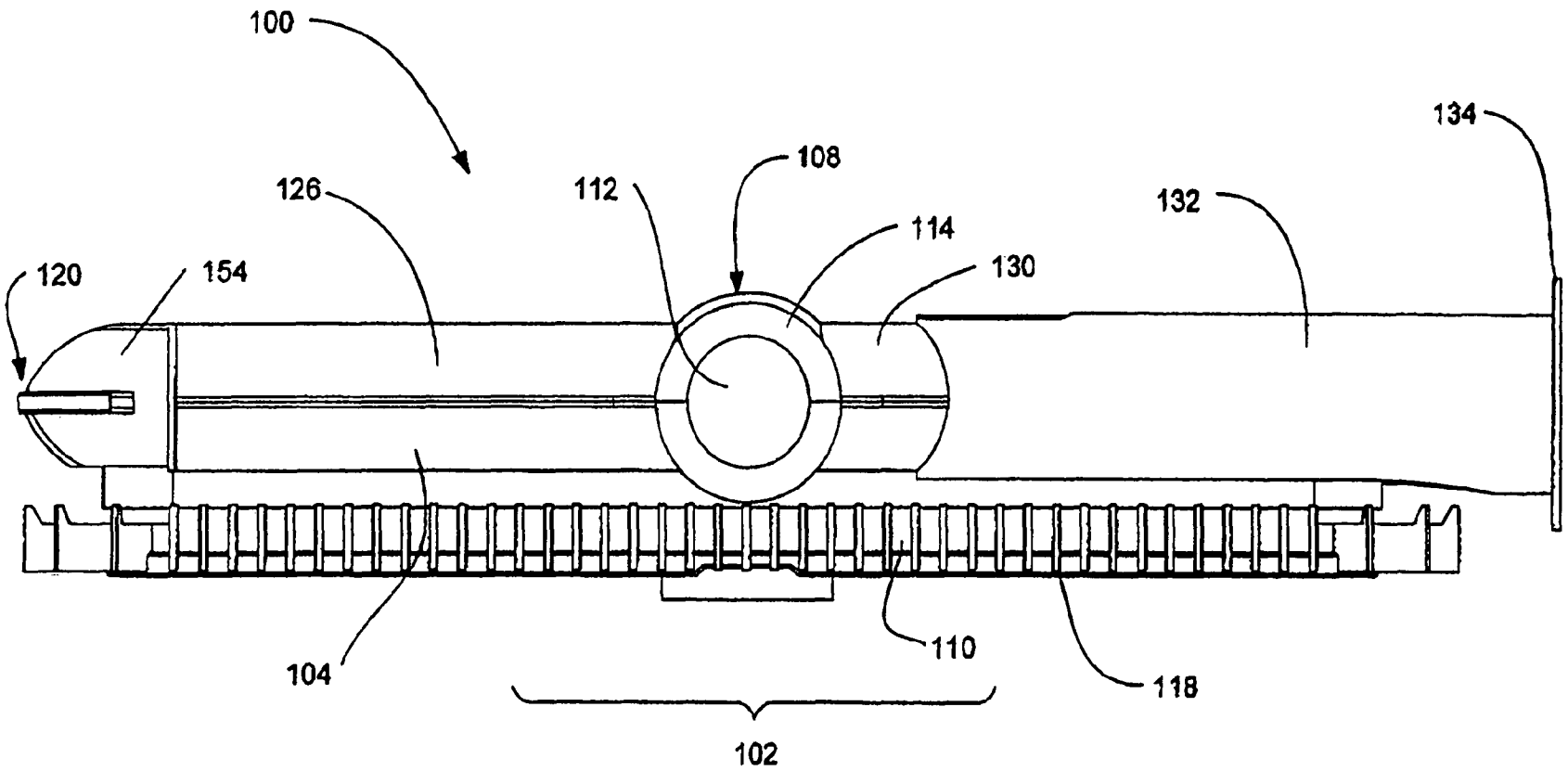
FIG. 1C is a side view of the apparatus in accordance with the present invention.
Figure 2A:
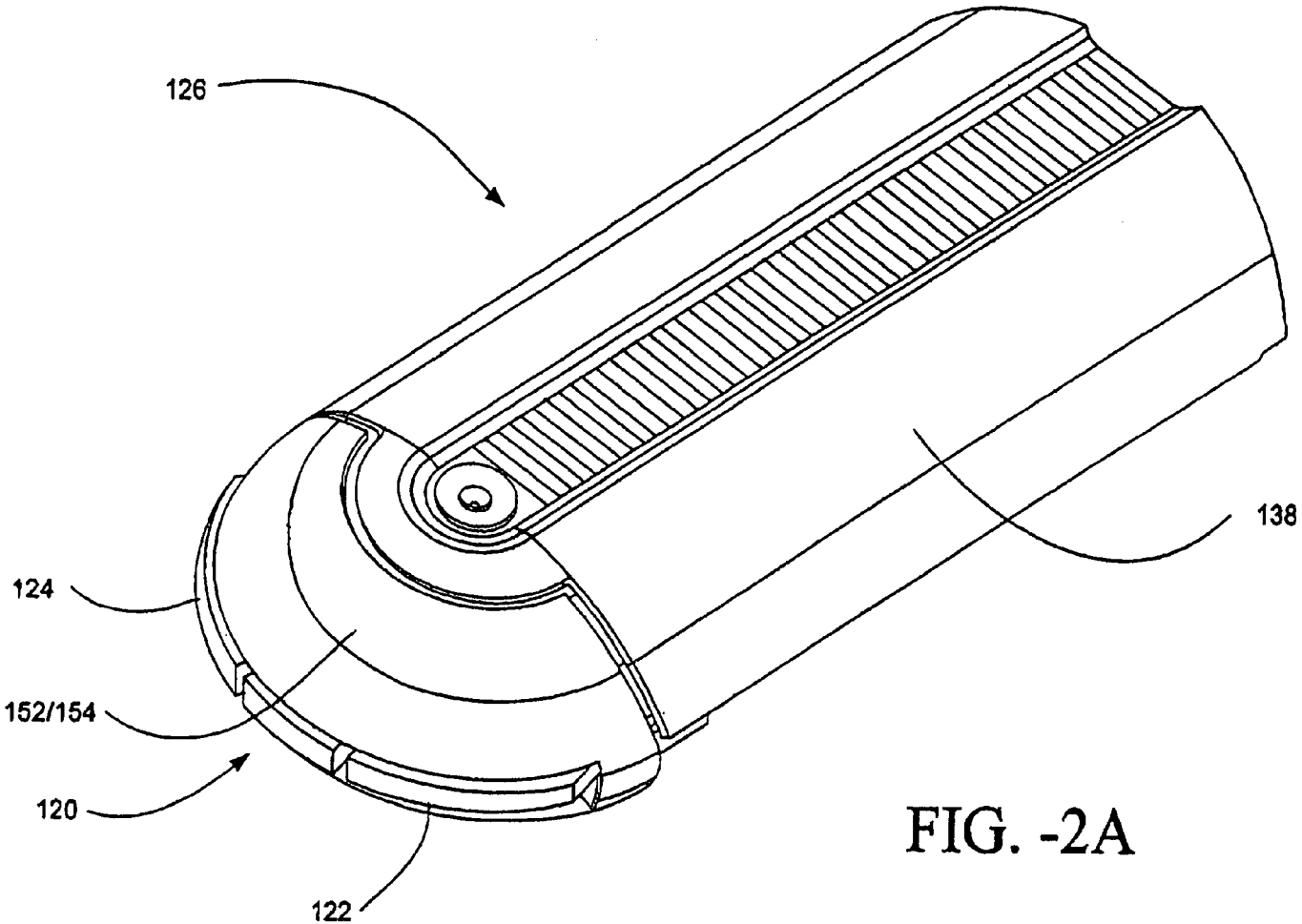
FIG. 2A is a top view of a battery pack of the apparatus in accordance with the present invention.
Figure 2B:
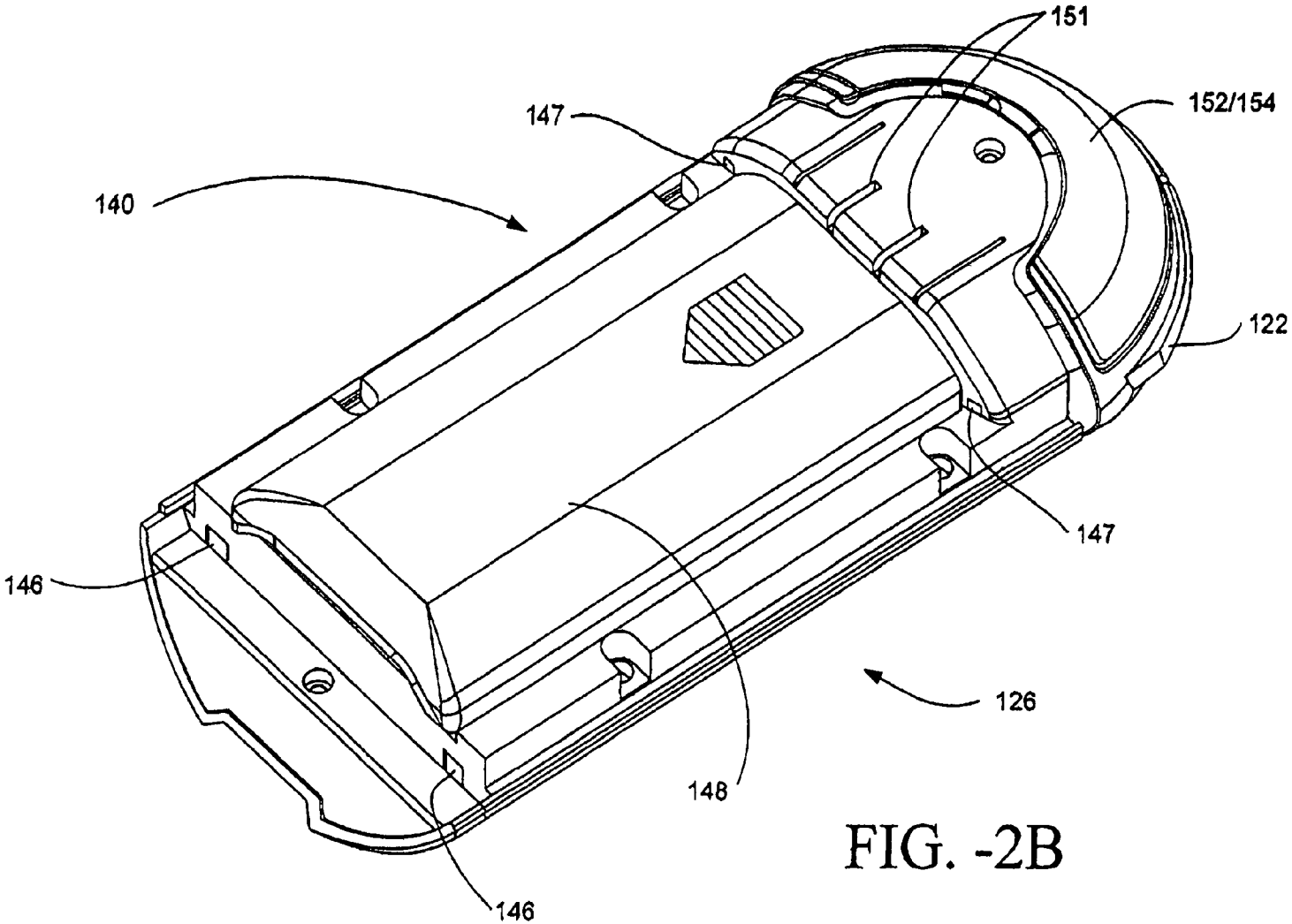
FIG. 2B is a bottom view of the battery pack of the apparatus, in accordance with the present invention.

FIGS. 1A and 1B provide perspective views from a back end (FIG. 1A) and a front end (FIG. 1B) of an embodiment of an apparatus of the present invention, and FIG. 1C provides a side view of the embodiment of the apparatus of the invention. The apparatus is a clothing accessory organizer 100, which is a dynamic device used for the storage, display, and retrieval of clothing accessories, such as neckties, scarves, belts, and other similar articles of clothing. The organizer 100 may also be used for the storage, display, and retrieval of items of jewelry, such as necklaces. As will be understood from the discussion herein, the organizer 100 overcomes the disadvantages of the static and dynamic devices discussed above by providing a more convenient system for replacing batteries and by providing a rod-mount that avoids entanglement of the clothing accessories stored on the organizer with other articles near that organizer.

Figure 7:
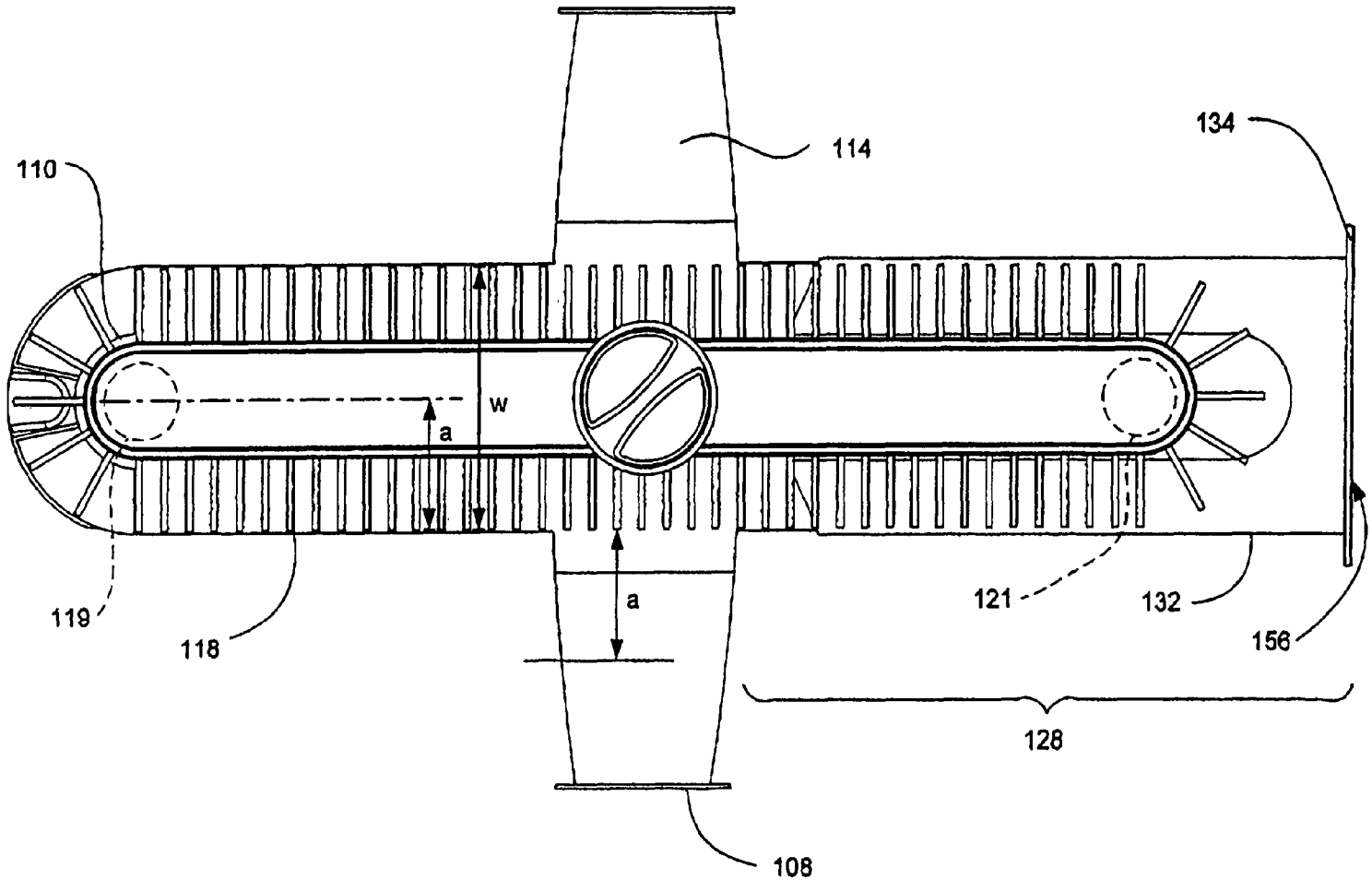
FIG. 7 is an underside view of the apparatus in accordance with the present invention.
Figure 8A:
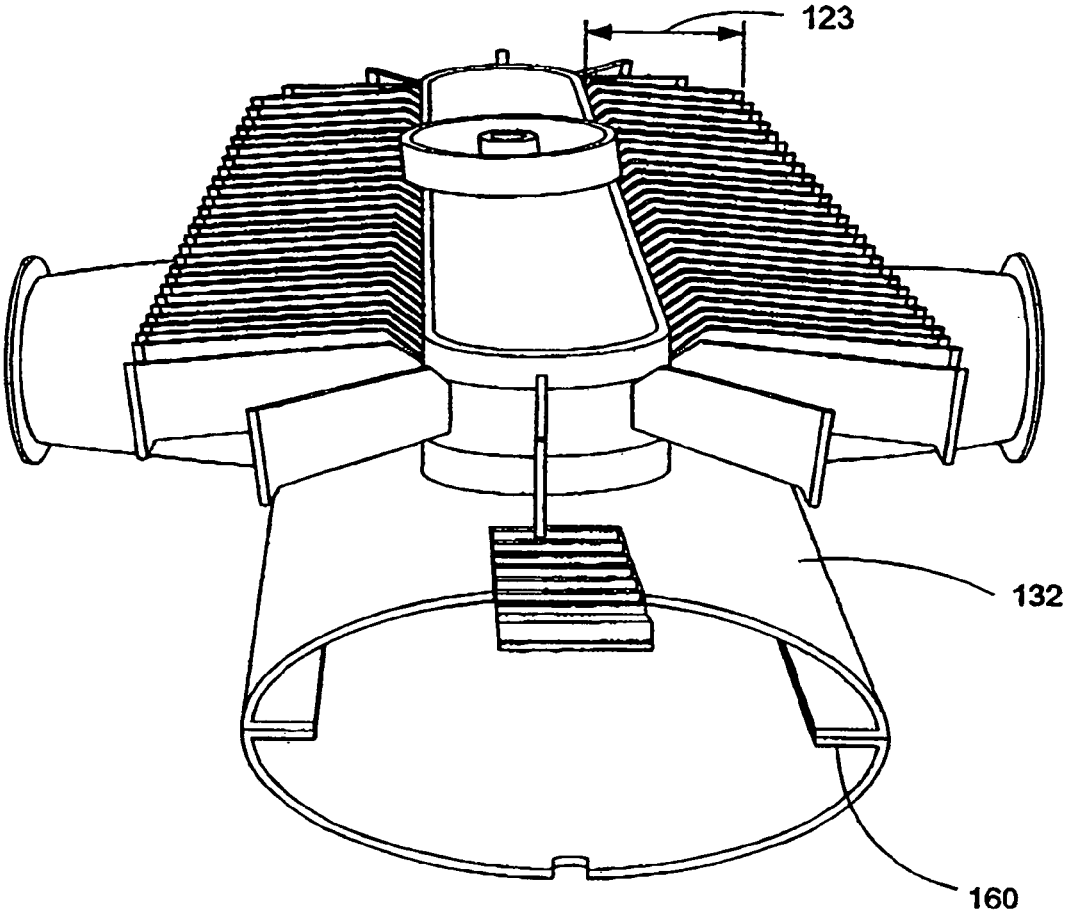
FIG. 8A is a back view from the back end of the apparatus in accordance with the present invention, with an endplate detached from the extendible sleeve.

In the full side view of the apparatus in FIG. 1C, it can be seen that the apparatus 100 has a first housing 102 which includes a front end or portion 104 and a back end or portion 106 separated from each other by a rod-mounting unit 108, and a belt 110 wrapped around drums 119/121 (FIG. 7). The belt 110 has a plurality of holders or hooks 118 from which articles of clothing can be hung. The holders or hooks 118 are formed integral with the belt 110 so that the holders or hooks 118 and the belt 110 form a single piece of plastic. The holders or hooks 118 have a length 123 (FIG. 8A).

The apparatus 100 may be mounted inside of a closet to the closet rod or bar (the type on which conventional garment hangers are hanged). The rod-mounting unit 108 of the housing 102 has a cavity 112 formed by a top unit 114 and a bottom unit 116 of the rod-mounting unit 108. This cavity receives the closet rod, and thus mounts the apparatus 100 to the closet rod. The rod-mounting unit 108 has a length that prevents or minimizes entanglement by other articles hung on the closet rod with the articles that are on the hooks 118 of the belt 110. The longer the length, the less likely it is that articles on the organizer will become entangled with other articles that may be stored on the closet rod or bar near the apparatus 100. In general, the rod-mounting unit 108 extends on either side of the ends of the hooks 118 by a length that is at least a length of a hook and preferably two to three times the length of a hook. The rod-mounting unit alternatively can extend from the distal tip of the hooks 118 for a length "a" that is at least one-half of a width of the apparatus, where the width is measured between two hooks 118 located directly opposite each other on different sides of the housing (FIG. 7).

Generally, the apparatus 100 is used by installing it in a convenient location, such as a closet, and hanging articles of clothing on the hooks 118. When a user wishes to locate a specific article, a switch bar 120 at the front end 104 of the apparatus 100 is depressed on either the right side 122 or the left side 124. When the right side 122 of the switch bar 120 is depressed, the drums rotate counter-clockwise (as viewed from the top), and when the left side 124 of the switch bar 120 is depressed, the drums rotate clockwise (as viewed from the top). The rotation of the drums causes the belt 110 to rotate, which moves the articles of clothing from the rear 106 of the apparatus to the front end 104 for easy retrieval.

One of the unique features of the apparatus 100 is an automatic control system, which causes the belt 110 to make a little more than one complete rotation when the switch bar 120 is depressed in either direction. The belt 110 automatically stops at the end of the complete rotation. By first making a complete rotation, the user is able to see every article that is on the belt 110 before making a selection. The rotation of the belt 110 stops at any time if the switch bar 120 is depressed in the opposite direction, or if the central portion of the switch bar 120 is depressed. Greater detail regarding the rotating of the belt 110 and hooks 118 is found in U.S. Pat. No. 5,474,187 to Taylor et al., which hereby is incorporated by reference.

FIGS. 1A, 1B, and 1C further show a second housing or battery pack 126 at the front end 104 of the apparatus, for powering a motor. At the back end 106 of the apparatus 100 is a telescoping unit 128 having an inner sleeve 130 (see FIG. 1C and FIG. 6) and an outer sleeve 132. An endplate 134 is connected with the outer sleeve 132 and abuts and adheres to a wall to brace and stabilize the apparatus 100 when the outer sleeve 132 slides over and extends from the inner sleeve 130 of the telescoping unit 128 toward the wall. With the outer sleeve 132 extended, the contact between the end plate 134 and the wall, stabilizes the apparatus 100.

Figure 3:
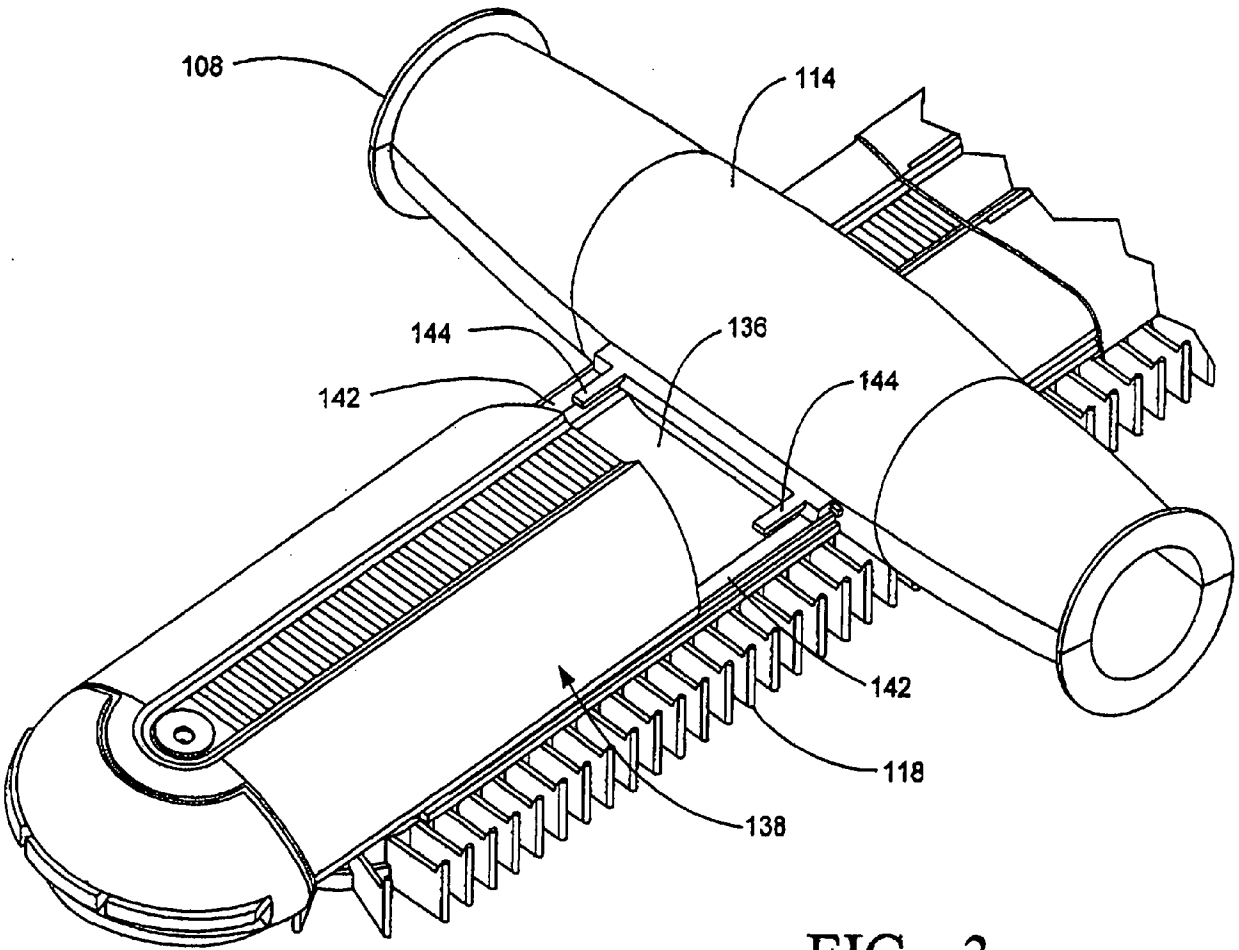
FIG. 3 is a top view of a front end of the apparatus with the battery pack sliding into or out of final position on a top side of the front end of the apparatus, in accordance with the present invention.
Figure 4:
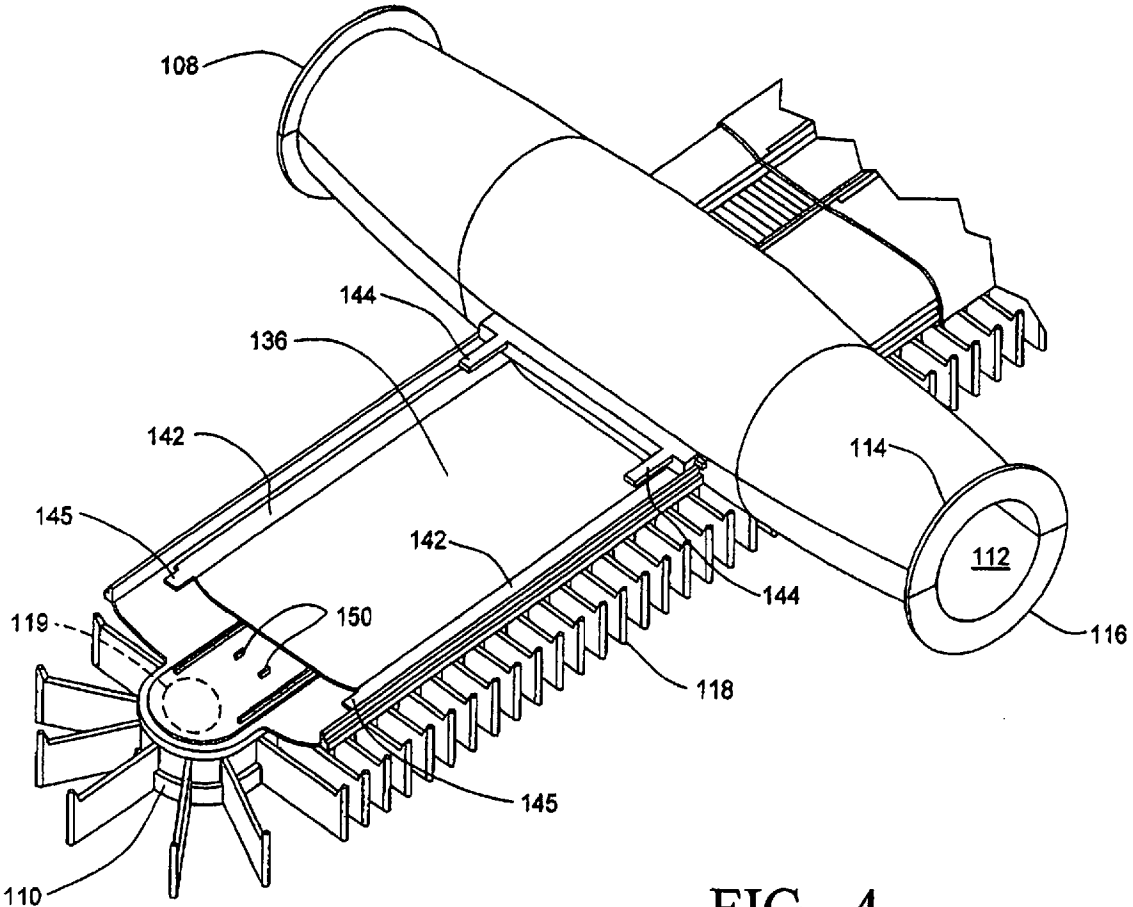
FIG. 4 is a top view of the front end of the housing of the apparatus in accordance with the present invention, with the battery pack removed.
Figure 5:
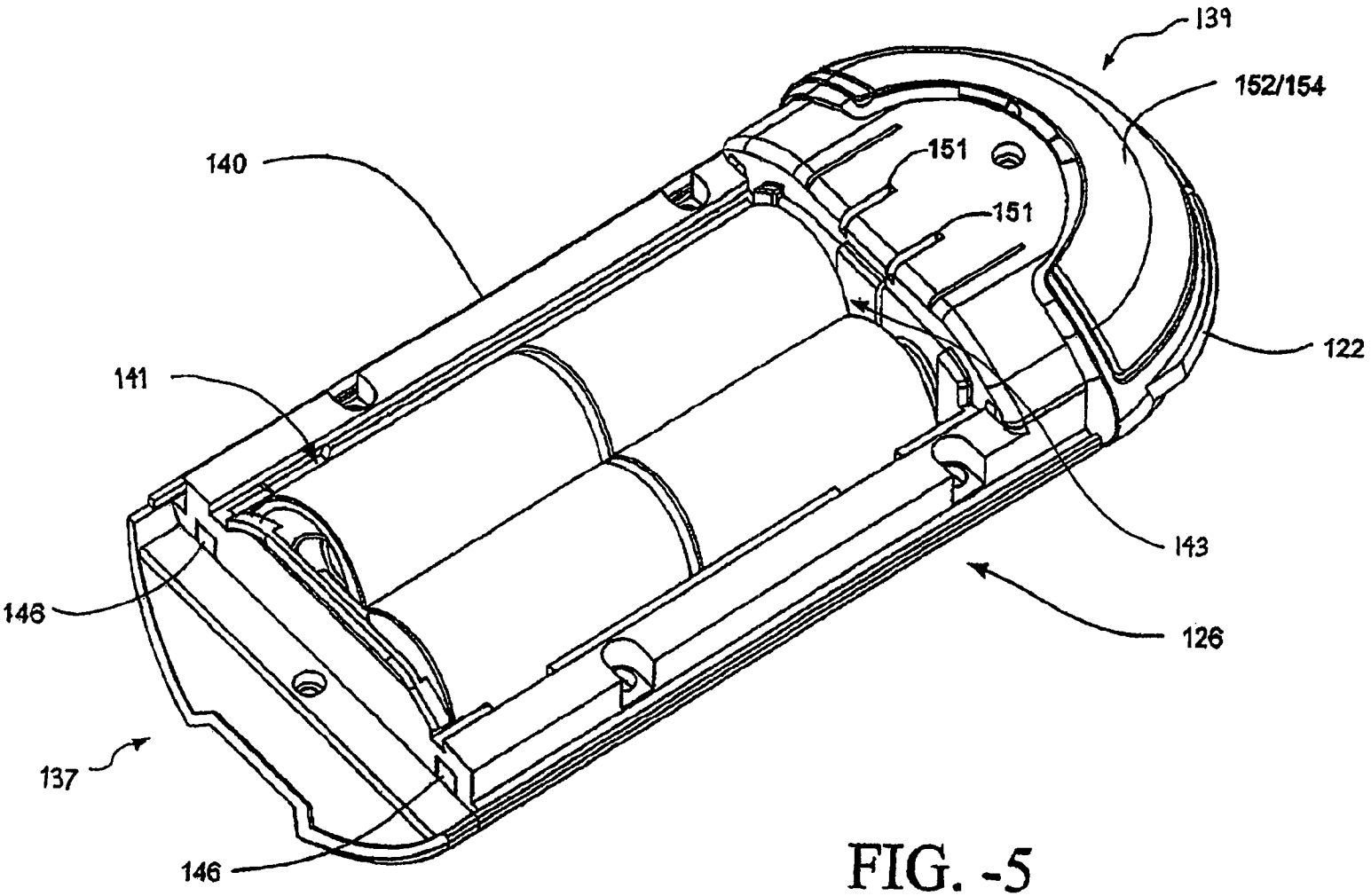
FIG. 5 is a bottom view of the battery pack of the apparatus separated from the housing, with a cover of the battery pack removed.

Turning now to each section of the apparatus 100 in greater detail, FIGS. 2A-5 depict a second housing or battery pack 126. The second housing 126 includes a support 141 defining a space 143, as illustrated in FIG. 5, in which batteries are held to power the motor. The drawings also show a mechanism by which the second housing or battery pack 126 can fit together, preferably with the top side 136 of the front end 104 of the first housing 102. The second housing or battery pack 126 includes: (a) a front portion 139, as illustrated in FIG. 5; (b) a back portion 137, as illustrated in FIG. 5; (c) a top side 138 (FIG. 2A); and (d) an underside 140 (FIG. 2B). The underside 140 of the second housing or battery pack 126 engages with the top side 136 of the front end 104 of the first housing 102, which is depicted in FIG. 3. The second housing or battery pack 126 and front end 104 of the first housing can be slid together along rails 142 on the top side 136 of the front end 104 of the first housing (FIG. 3) and snapped together by at least on prongs 144, 145 in the top side 136 of the front end 104 of the first housing 102, which fits into compatible slots 146, 147 (FIG. 2B) in the underside 140 of the second housing or battery pack 126, when the second housing or battery pack 126 is slid into position in the front end 104 of the first housing 102. The second housing or battery pack 126 can be slid out from the front end 104 of the first housing 102 without having to dismount the apparatus 100 from the rod. A cover 148 on the bottom 132 of the second housing or battery pack 126 can be removed to replace the batteries as needed (see FIG. 2B and FIG. 5). The cover 148 of the second housing or battery pack 126 is then repositioned over the new batteries after replacing the old batteries, and the second housing or battery pack 126 is slidably moved along the top side 136 of the front end 104 of the first housing 102 until the prong(s) 144, 145 engage with the slot(s) 146, 147. Prongs 150 (FIG. 4) on the top side 136 of the front end 104 of the first housing 102 can plug into slot(s) 151 at a distal end or front portion 139 of the battery pack 126.

As seen in FIGS. 1A-C, 2A, 2B, and 5, the second housing or battery pack 126 can also have mounted on a distal end or front portion 139 (which is the front end 104 of the apparatus 100) a light 152 for viewing selections as the selections are rotated past the front end 104 of the apparatus 100. The light 152 can be covered with a translucent or transparent window 154 which can be made of plastic or any other transparent or translucent material that transmits light. Because of the light feature 152, the second housing or battery pack 126 can be removed from the apparatus 100 as described above, not only for changing batteries, but also for use as a flashlight.

Figure 8B:
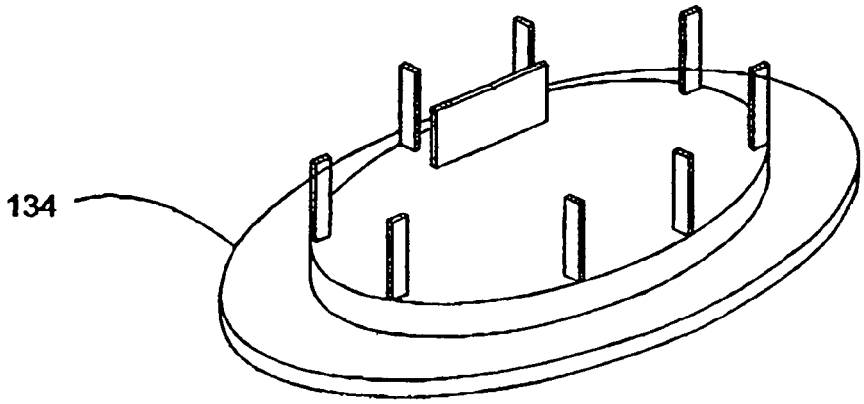
FIG. 8B is a perspective view of an inside surface of an endplate that is detached from the extendible sleeve.
Figure 9:
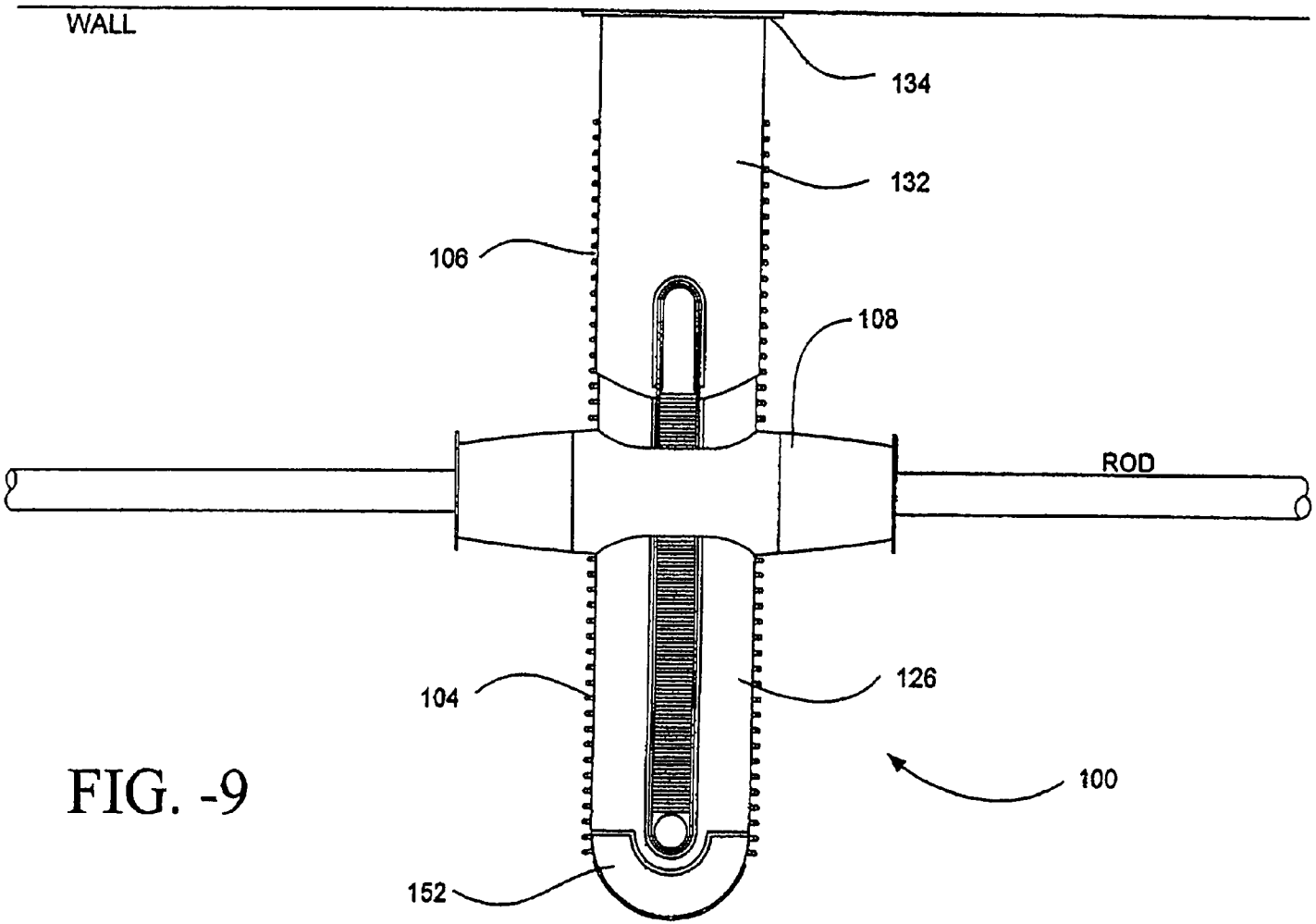
FIG. 9 is a side view showing the mounted device braced against a wall.

Turning now to FIGS. 6-9, these drawings depict the back end 106 of the housing 102, which is extendible by a telescoping unit 128. The telescoping unit 128 has an extendible outer sleeve 132. The user can slide the extendible sleeve 132 outward and backward from the back end 106 of the housing 102. This extension can continue until an endplate 134, mounted to the distal end of the extendible sleeve 132, abuts a wall or other surface (FIG. 9). The endplate 134 can have adhesive, such as double-sided tape or any other suitable adhesive, on an outer surface 156 of the removable endplate 134 to adhere to the wall and thus to stabilize the mounted apparatus 100 against the wall. Alternatively, the endplate 134 can have a plurality of bore holes for receiving nails and/or screws to mount the endplate 134 to the wall, together with or in the absence of the adhesive indicated above. The endplate 134 also can be removable from the outer sleeve 132 (see FIG. 8B).

Figure 6:
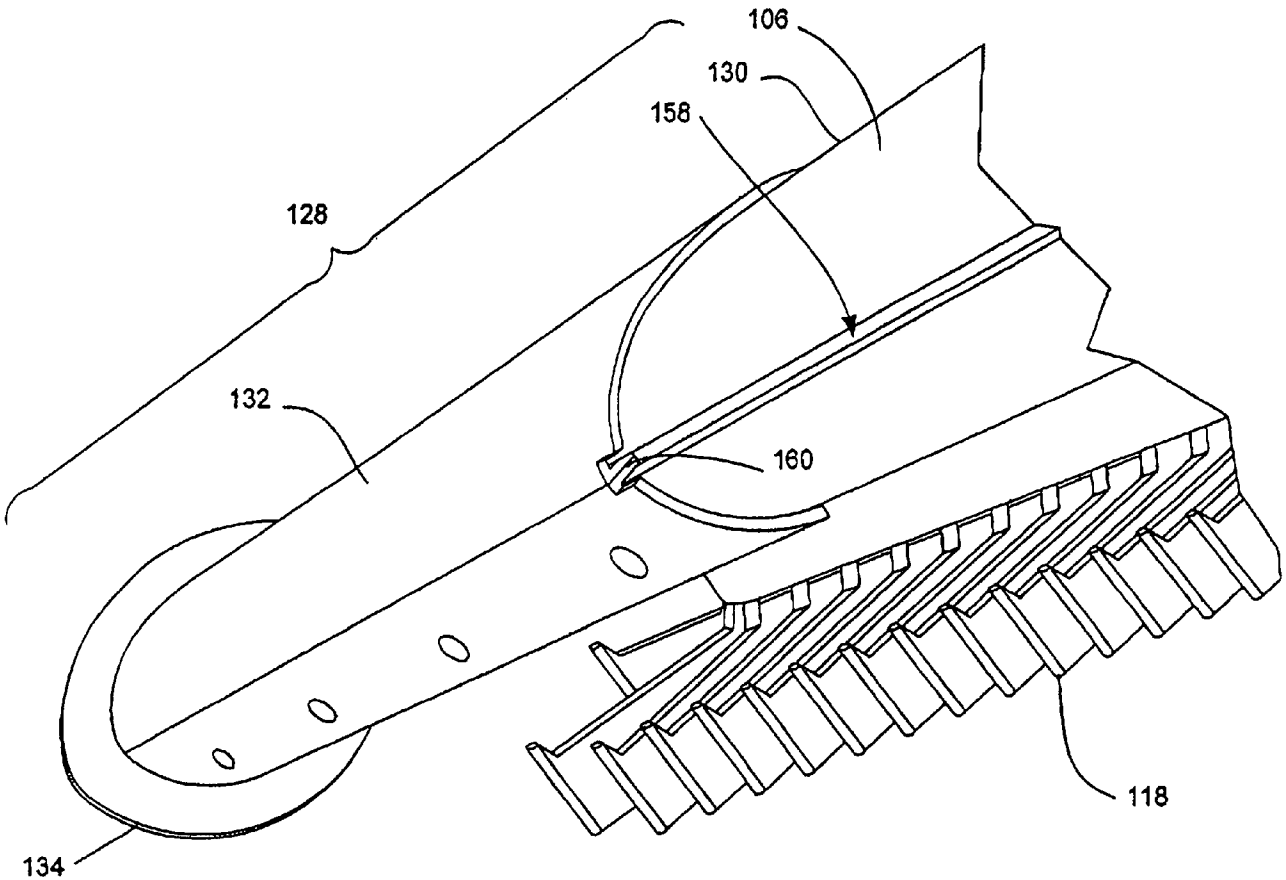
FIG. 6 is a side perspective view of a back end of the apparatus, in accordance with the present invention, the back end having an extendible sleeve.

FIGS. 6, 8A, and 8B show the use of a guide rail system for sliding the extendible sleeve 132 over the back end 106 of the housing 102 to extend the telescoping unit 128 and endplate 134 toward the wall. The back end 106 of the housing 102 has at least one groove 158. Compatible rails 160 are found along an inner surface of the extendible sleeve 132 which slide inside the groove 158 of the back end 106 of the housing 102.

Figure 10:
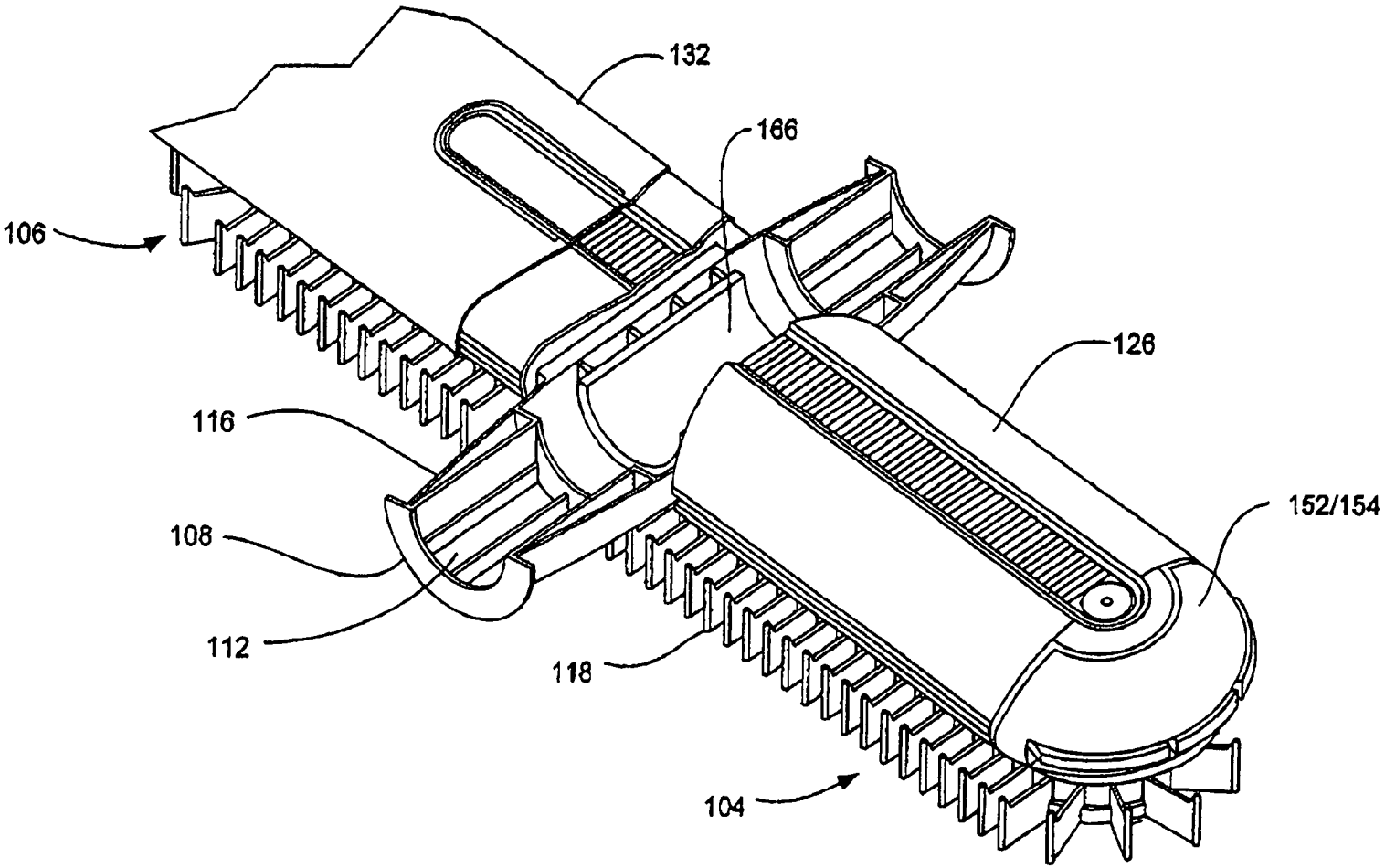
FIG. 10 is a top view of the apparatus in accordance with the present invention, with a top unit of the rod-mounting unit removed.
Figure 11:
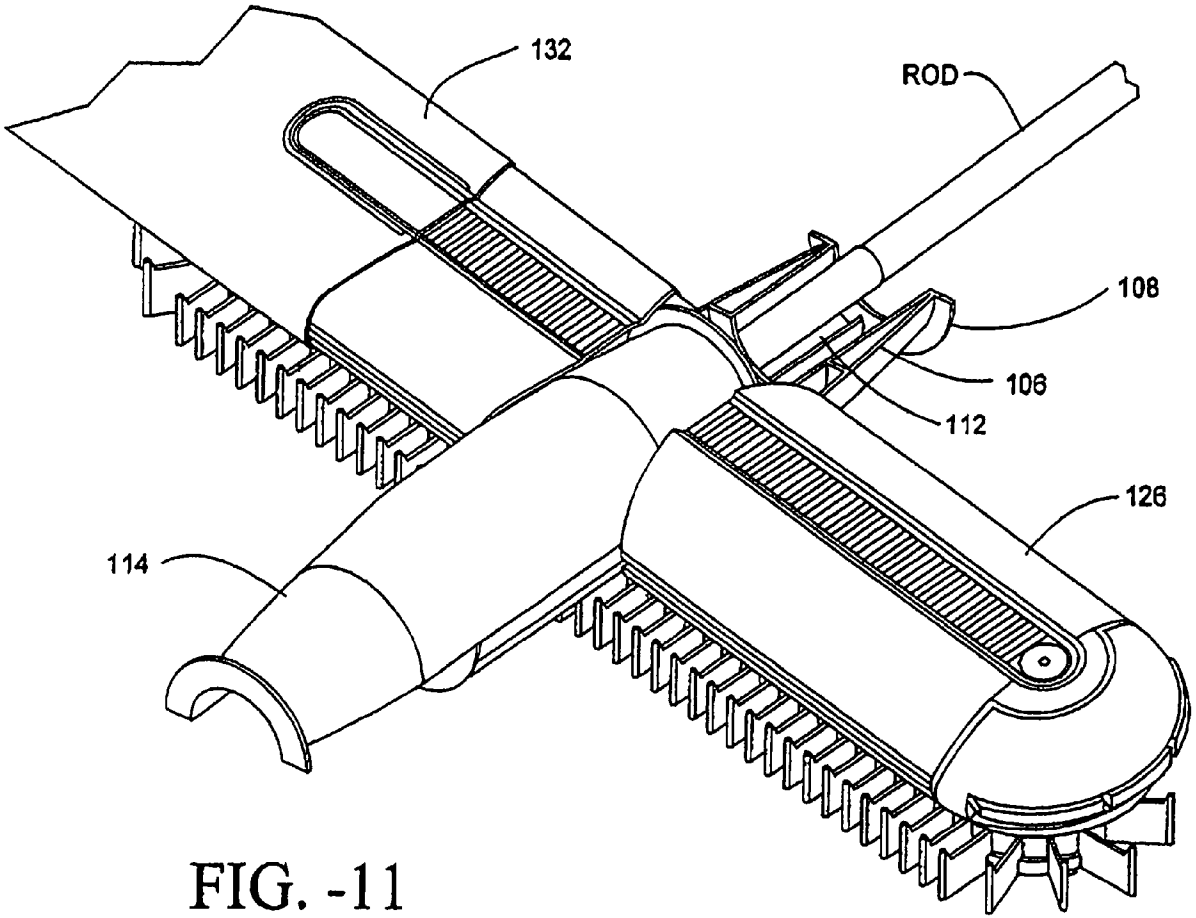
FIG. 11 is a top view of the apparatus in accordance with the present invention, showing the top unit of the rod-mounting unit being slidably engaged with the bottom unit of the rod-mounting unit to mount the apparatus on a rod.
Figure 12:
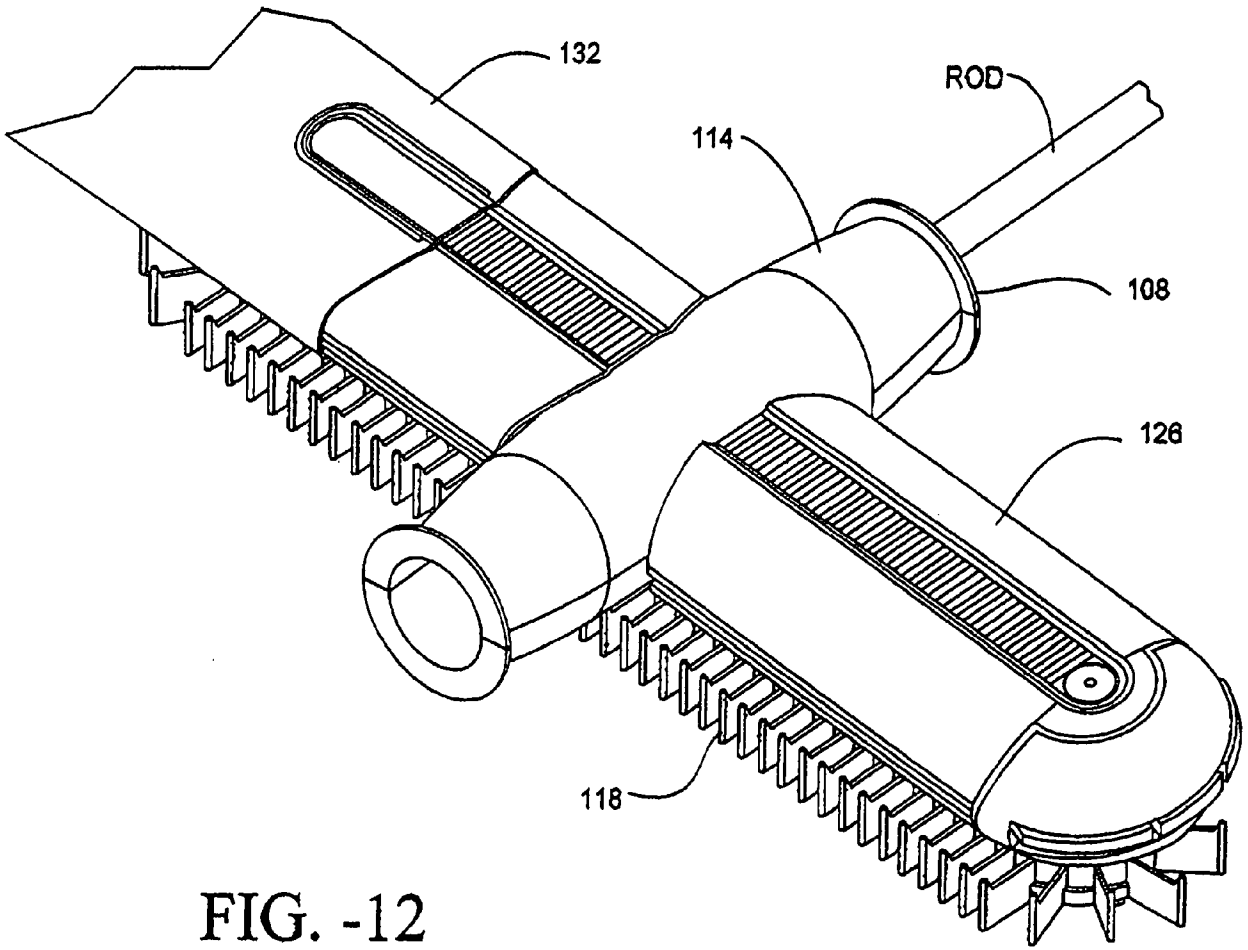
FIG. 12 is a top view of the apparatus in accordance with the present invention, showing the rod-mounting unit fully-assembled around a rod.

Turning now to FIGS. 10-12, these drawings depict the rod-mounting unit 108 in detail. The rod-mounting unit 108 has a cavity 112 formed by a top unit 114 and a bottom unit 116 of the rod-mounting unit 108. To assemble the rod-mounting unit 108, the apparatus 100 can be sustained so that the bottom unit 116 fits around a rod in a closet. From over the top of the rod in the closet, the user then slidably engages the top unit 114 with the bottom unit 116 of the rod-mounting unit 108 (FIG. 11). As the top unit 114 slides along the axis of the rod, a plurality of prongs 162 in the top unit 114 can meet with a plurality of compatible slots 164 in the bottom unit 116 and the top unit 114 and bottom unit 116 thus can engage to form the cavity 112 around the rod and sustain the apparatus 100 mounted on the rod. Alternatively, the prongs 162 can be in the bottom unit 116 and the slots 164 can be in the top unit 114. The described mechanism allows for simple assembly by sliding and snapping into place the rod-mounting unit 108. A bolt through a bore in the bottom of the housing 102 also can be used to fasten the apparatus 100 to the rod, as set forth in U.S. Pat. No. 5,474,187 to Taylor et al., incorporated herein by reference.

As depicted in FIG. 10, the rod-mounting unit 108 can be adapted to accommodate rods of different shapes that can be found in a closet, i.e., rods that are cylindrical, as well rods that have other than circular shapes in cross-section, for example, an elliptical cross-sectional shape. Adaptation can be accomplished with an insert 166 that is placed within the cavity 112 of the rod-mounting unit 108. FIG. 14 depicts an end view of the bottom unit 116 of the rod-mounting unit 108, the cavity 112 of which bottom unit accommodates a substantially cylindrical rod. With an insert 166 in the cavity 112 of the bottom unit 116, however, the shape of the cavity 112 is altered to accommodate a rod that is, by way of example only, elliptically shaped in cross-section. In a preferred embodiment, the insert 166 is an elongated piece which fits in the bottom unit 116 of the rod-mounting unit 108, to create a cavity 112 that has other than a semi-circular shape in cross-section, so that the insert 166 fits with the rod which has other than a circular shape in cross-section. The present invention also contemplates that the insert could fit in the top unit 114 of the rod-mounting unit 108.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. An apparatus usable in conjunction with a clothing rod, the apparatus comprising:

a first housing having:

(a) a front portion;

(b) a back portion;

(c) a rod mounting unit positioned between the front portion and the back portion;

a drive mechanism supported by the first housing;

a plurality of holders operatively coupled to the drive mechanism; and a removable battery pack configured to be removably attached to the front portion of the first housing, the removable battery pack having:

(a) a support defining a space, the support being configured to hold at least one battery;

(b) a back portion;

(c) a front portion positioned opposite of the back portion;

(d) at least one light source supported by the support, the light source being positioned adjacent to the front portion of the removable battery pack; and (e) a cover configured to be movably attached to the support to provide access to the space;

wherein the removable battery back can be used separately from the first housing as a standalone light source.

2. The apparatus of claim 1, wherein the mounting unit extends a length beyond the plurality of hooks.

3. The apparatus of claim 1, wherein the cover is configured to be removable from the removable battery pack.

4. The apparatus of claim 1, wherein the hooks are configured to support articles of clothing.

5. The apparatus of claim 1, wherein the mounting unit is configured to be coupled to different sized rods.

6. The apparatus of claim 1, wherein the removable battery pack is configured to be removable from the first housing without dismounting the first housing from the clothing rod.

7. The apparatus of claim 1, wherein the removable battery pack is configured to slidably engage the first housing.

8. The apparatus of claim 1, wherein the support supports an operating switch for a motor supported by the first housing.

9. The apparatus of claim 1, wherein the back portion of the first housing includes an endplate.

10. The apparatus of claim 1, wherein the back portion of the first housing includes a telescoping structure having an adjustable length.

11. The apparatus of claim 1, wherein the back portion of the removable battery pack is positioned adjacent to the rod mounting unit when the removable battery pack is attached to the first housing.

12. An apparatus usable in conjunction with a clothing rod, the apparatus comprising:

a first housing having:

(a) a front portion having at least one prong;

(b) a back portion;

(c) a rod mounting unit positioned between the front portion and the back portion;

a drive mechanism supported by the first housing;

a plurality of holders operatively coupled to the drive mechanism; and a removable battery pack configured to be removably attached to the front portion of the first housing, the second housing removable battery pack having:

(a) a support defining a space, the support being configured to hold at least one battery;

(b) a back portion positioned adjacent to the rod mounting unit when the removable battery pack is attached to the first housing;

(c) a front portion positioned opposite of the back portion;

(d) at least one light source supported by the support, the light source being positioned adjacent to the front portion of the removable battery pack; and (e) a cover configured to be movably attached to the support to provide access to the space;

wherein the removable battery back can be used separately from the first housing as a standalone light source.

13. The apparatus of claim 12, wherein the mounting unit extends a length beyond the plurality of holders.

14. The apparatus of claim 12, wherein the cover is configured to be removable from the removable battery pack.

15. The apparatus of claim 12, wherein the removable battery pack is configured to be removable from the housing without dismounting the first housing from the clothing rod.

16. The apparatus of claim 12, wherein the back portion of the first housing includes an endplate.

17. The apparatus of claim 12, wherein the back portion of the first housing includes a telescoping structure having an adjustable length.

18. The apparatus of claim 12, wherein the removable battery pack is configured to slidably engage the first housing.

19. An apparatus usable in conjunction with a clothing rod, the apparatus comprising:

a first housing having:

(a) a body having a left side, a right side, a front portion, and a back portion;

(b) a rod mounting unit positioned between the front portion and the back portion, the rod mounting unit having:

(i) a right portion extending beyond the right side; and (ii) a left portion extending beyond the left side;

a drive mechanism supported by the first housing;

a plurality of holders operatively coupled to the drive mechanism;

a removable battery pack configured to be removably attached to the front portion of the first housing, the removable battery pack having:

(a) a support defining a space, the support being configured to hold at least one battery;

(b) a back portion positioned adjacent to the rod mounting unit when the removable battery pack is attached to the first housing;

(c) a front portion positioned opposite of the back portion;

(d) at least one light source supported by the support, the light source being positioned adjacent to the front portion of the removable battery pack; and (e) a cover configured to be movably attached to the support to provide access to the space;

wherein the removable battery back can be used separately from the first housing as a standalone light source.

20. The apparatus of claim 19, wherein the cover is configured to be removable from the removable battery pack.

21. The apparatus of claim 19, wherein the removable battery pack is configured to be removable from the housing without dismounting the first housing.

22. The apparatus of claim 19, wherein the back portion includes an endplate.

23. The apparatus of claim 19, wherein the back portion of the first housing includes a telescoping structure having an adjustable length.

24. The apparatus of claim 19, wherein the removable battery pack is configured to slidably engage the first housing.

25. The apparatus of claim 19, wherein the back portion of the first housing includes an endplate.

* * * * *